US005896928A

United States Patent [19]

Coon

[11] Patent Number: 5,896,928

[45] Date of Patent: Apr. 27, 1999

[54] FLOW RESTRICTION DEVICE FOR USE IN PRODUCING WELLS

[75] Inventor: Robert J. Coon, Houston, Tex.

[73] Assignee: Baker Hughes Incorporated, Houston, Tex.

[21] Appl. No.: 08/673,483

[22] Filed: Jul. 1, 1996

[51] Int. Cl.[6] ..... E21B 47/00

[52] U.S. Cl. ..... 166/373; 166/66.7; 166/205

[58] Field of Search ..... 166/66.7, 205, 166/227, 229, 238, 242.3, 334.1, 334.4, 373

[56] References Cited

U.S. PATENT DOCUMENTS 5,355,949 10/1994 Sparlin et al. ..... 166/236
5,355,953 10/1994 Shy et al. ..... 166/66.7 X

FOREIGN PATENT DOCUMENTS 2 198 767 6/1988 United Kingdom .
2 262 954 7/1993 United Kingdom .

*Primary Examiner*—William P. Neuder
*Attorney, Agent, or Firm*—Madan & Morris, PLLC

[57] ABSTRACT

The present invention provides a fluid flow control device for controlling the formation fluid flow rates through a production string. The device includes a generally tubular body for placement into the wellbore. The tubular body has a screen at an outer surface for preventing sand from entering into tabular body. The fluid flowing through the screen passes through a labyrinth. A slidable sleeve on the labyrinth controls the fluid velocity there through. The slidable sleeve screen is moved by an electrically-operated device, such as a motor paced in the production string. The fluid leaving the labyrinth passes to a tubing in the tubular body for carrying the fluid to the surface. The flow control device further may include a control circuit in the production string for controlling the operation of the electrically-operated device. The control circuit may communicate with the a surface control unit, preferably a computer-based system, which may provide commands to the downhole control circuit for causing the electrically-operated device to adjust the position of the sleeve. The sleeve may be positioned at any place on the labyrinth, providing accurate control over the flow rate. The surface control unit may communicate with the downhole control circuit via a data communication link, which may be a cable or a trans/receiver system.

31 Claims, 2 Drawing Sheets

FLOW RESTRICTION DEVICE FOR USE IN PRODUCING WELLS

BACKGROUND OF THE INVENTION

1. Field of the Invention

This invention relates generally to a apparatus for use in wellbores for recovery of hydrocarbons and more particularly to a production string having a remotely controllable inflow control device for controlling the flow of hydrocarbons from production zones into a production tubing.

2. Background of the Art

To produce hydrocarbons from wellbores, perforations are made through production zones or zones of interest. In cased hole applications, a wellbore casing is placed in the wellbore and the annulus between the casing and the wellbore is filled with a concrete slurry. Perforations are then made through the casing and the concrete and into the production zones for flowing hydrocarbons (formation fluids) from the production zones into the casing. A production string is then placed inside the casing, creating an annulus between the casing and the production string. The fluid from the annulus flows into the production string and is then transported to the surface via a tubing associated with the production string. In open hole applications, the wellbore is typically gravel-packed and a suitable production string is placed in the gravel pack for transporting formation fluids to the surface.

The production string typically includes a sand control device around its outer periphery, which is placed adjacent to each perforated zone to prevent the flow of sand from the production zone into the production string. Sand screens of various designs and slotted liners are commonly used for such purpose. The fluid from the production zone flows through the sand control device and into the production tubing.

The formation fluid resides in the producing formations at a relatively high temperature and at a high pressure. It frequently contains abrasive constituents. The formation fluid, if allowed to pass through the various components of the production string at high flow rates, can quickly erode such components. The velocity of the fluid at which the components start to erode is referred to as the "erosion velocity." The erosion velocity depends upon the type of formation fluid, types of materials used for such components, and the design of such components. A flow control device is typically placed in the production string to create a pressure drop after the formation fluid enters the production string to maintain the fluid flow below the erosion velocity.

Sleeve-type devices have been utilized as flow control devices. Such devices utilize a sleeve placed between the sand screen and the production string interior. In one type of sleeve-type flow control device, to adjust the flow rate through the device, a shifting tool conveyed from the surface, generally by a tubing, is used to move the device between an open position and a closed position. The open position generally defines a fully open valve and the closed position generally defines a position that completely prevents any fluid flow into the production string.

More recently, a sliding sleeve-type device has been proposed that may be set at a selected one of several positions to control the fluid flow rate into the production string. U.S. Pat. No. 5,355,953 discloses such a sleeve-type valve, which is set downhole at one of several positions to control the fluid flow rate. To adjust the flow rate, an external device, such as shifting tool, placed within the production tubing is used to alter the position of the sleeve.

Another type of flow restriction device utilizes a sleeve having a labyrinth for creating a pressure drop before the fluid is allowed to enter the production string interior. The fluid is passed through a predetermined length of a tortuous path before it enters the production string interior. The amount of the pressure drop depends upon the length of the labyrinth through which the fluid must pass. The labyrinth-type devices are preset at the surface before installation in the wellbore. To alter the flow rate, such devices must be retrieved and reset at the surface. This approach can be very expensive, as it requires shutting down the production.

The above-described prior art devices require certain types of intervention to change the flow rate through these devices. Such operations, even if infrequently employed, are expensive and in many cases require shutting down production. It is thus desirable to have a system wherein the fluid flow rate through the production string may be accurately and remotely controlled, without interrupting production operations.

The present invention provides a system wherein the formation fluid leaving the sand screen is passed through an electrically actuated, remotely controllable, adjustable fluid flow control device, which enables adjusting the flow rate to any desired level.

SUMMARY OF THE INVENTION

The present invention provides a fluid flow control device for controlling the formation fluid flow rate through a production string. The device includes a generally tubular body for placement into the wellbore. The tubular body has a screen at an outer surface for preventing sand from entering into tabular body. The fluid flowing through the screen passes through a labyrinth. A slidable sleeve on the labyrinth controls the fluid velocity therethrough. The slidable sleeve is moved by a remotely and electrically-operated device placed in the tubular body. The fluid leaving the labyrinth passes to a tubing in the tubular body for carrying the fluid to the surface.

The flow control device further may include a control circuit for controlling the operation of the electrically-operated device. The control circuit may communicate with the a surface control unit, preferably a computer-based system, which may transmit command signals to the control circuit for causing the electrically-operated device to adjust the sleeve position. The sleeve may be positioned at any place on the labyrinth, providing accurate control over the fluid flow rate. The surface control unit may communicate with the downhole control circuit via a suitable data communication link, which may be a cable or a transmitter/receiver unit.

For wellbores having multiple production zones, a separate flow control device is placed adjacent to each perforated zone. The flow control devices may be independently controlled from the surface control unit, without interrupting the fluid flow through the production string. The flow control devices may communicate with each other and control the fluid flow based on instructions programmed in their respective control circuits and/or based on command signals provided from the surface control unit.

The present invention provides a method for controlling the flow of a fluid from a formation into a production string placed in a wellbore, comprising: (a) placing the production string in the wellbore, the production string having a sand control device for preventing the flow of certain solids from entering from the formation into the production string; (b) allowing the passage of the formation fluid from the formation into the production string through the sand control device; (c) passing the formation fluid entering into the production string through a labyrinth; and (c) selectively controlling the flow of the fluid through the labyrinth by adjusting the position of a sliding sleeve on the labyrinth by an electrically-operated device.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DETAILED DESCRIPTION OF PREFERRED EMBODIMENTS

Figure 1:
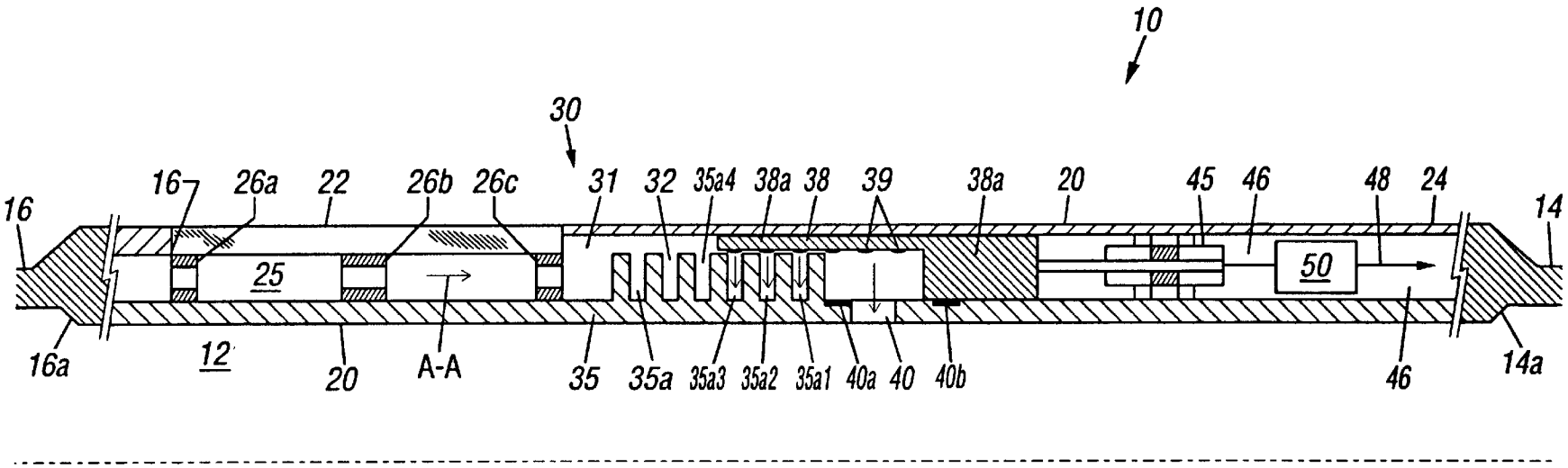
FIG. 1 shows a longitudinal partial cross-sectional view of one embodiment of a flow restriction device according the present invention for use in a producing wellbore.

FIG. 1 shows a partial cross-sectional view of an flow control device 10 (also referred to as the inflow control device) according to one embodiment of the present invention. In use, the device 10 is placed in a wellbore adjacent to a producing zone which has been perforated to allow the formation fluids or effluent, such as hydrocarbons (oil and gas), to flow from the formation into a casing placed in the wellbore. The device 10 is substantially a tubular device having an elongated body 20 and an axial bore or a through passage 12 therethrough. The device 10 includes a suitable profile and/or a connector 14*a* at an upper end 14 for connecting the device 10 to a suitable device or a tubing (not shown). The lower portion of the device 10 also includes a suitable profile or a connector 16*a* for connecting the device 10 to a suitable device (not shown).

The elongated body 20 includes a sand control device 22, placed around and spaced from a portion of the periphery of the body 20, creating a space 25 between the sand control device 22 and the body 20. The sand control device 22 is provided to prevent entry of sand and other small solids from the formation into the flow control device 10. Various types of sand control devices, including wire mesh, welded wire-type mesh and slotted-sleeve-type devices, are used in production strings in the oil and gas industry. Any such sand control device may be utilized for the purpose of this invention. One or more flow spacers, such as the illustrated spacers 26*a*–26*c*, are placed between the sand screen 22 and the body 22. The spacers 26*a*–26*c* allow the formation fluid to pass from the region 25 between the sand control device 22 and the body 24 uphole in the direction labeled as A—A.

The formation fluid passes from the sand control device 22 to the region or section 25. The fluid from the region 25 passes into a flow restriction device 30 via the spacers 26*a*–*c*. The flow restriction device 30 is suitably placed between the body 20 and an outer section 24, which is concentric to the body 20. The flow restriction device 30 contains a section that has a continuous helical or spiral fluid channel or groove 32 around its outer periphery. The channel 32 forms a labyrinth 35, providing a tortuous fluid flow path in the section 30. A sleeve 38, coaxial to the body 20, is slidably placed over the labyrinth 35 for controlling the flow of the formation fluid from the region 25 into the interior 12 via a port 40. The sleeve 38 contains a section 38*a* that preferably contains resilient inner surface protrusions, generally denoted herein by numeral 39. The protrusions 39 are spaced so that they will cover the individual grooves 35*a* when the sleeve 38 is slid over the labyrinth 35, thereby preventing the fluid flow over the grooves.

In FIG. 1, the sleeve 38 is shown to block the first three grooves or loops $\mathbf{35}_{a1}$–$\mathbf{35}_{a3}$ the labyrinth 35. In this position, the fluid from the region 25 will flow freely into the region 31 and up to the loop $\mathbf{35}_{a4}$. The fluid is then forced to flow through each of the loops $\mathbf{35}_{a1}$–$\mathbf{35}_{a3}$. Thus, the length of the tortuous path formed by the loops $\mathbf{35}_{a1}$–$\mathbf{35}_{a3}$ defines the pressure drop between the region 25 and the port 40 and, hence, the fluid velocity from the formation to the port 40. The sleeve 38 also includes a lower sliding section 38*a* that slides along the body 20. The section 38*a* may be designed so that it may fully close the port 40, such as when the edge 41 of the sleeve 38 is in the region defined by the seal 40*a*. The sleeve 38 keeps the port fully open when its edge 41 is in the region 40. In between the regions defined by seals 40*a* and 40*b*, the port 40 remains partially open. Alternative sleeve design may be chosen, wherein the port 40 remains fully open regardless of the position of the sleeve 38 over the labyrinth 35.

The sleeve 38 is preferably moved or operated to move by an electrically-operated device 45, such as a motor, which is operatively coupled to the sleeve 38 and placed in a region or section 46 between the body 20 and the tubular member 24. A control circuit 50 preferably placed in the device 10 controls the operation of the sleeve 38. The control circuit 50 preferably communicates with a surface control unit (see element 180, FIG. 2 and related description), such as a computer, via a suitable data communication link 48, which may be a cable or a wireless transmitter/receiver unit.

In operation, the device 10 is placed adjacent to the perforations of a producing formation. The formation fluids pass through the sand control device 22 and flow into the section 25. The fluid from section 25 passes through the tortuous path defined by the location of the sleeve 38 over the labyrinth 35. The fluid leaving the labyrinth 35 then enters the bore 12 via the port 40, from whence it is transported to the surface via a suitable tubing.

Figure 2:
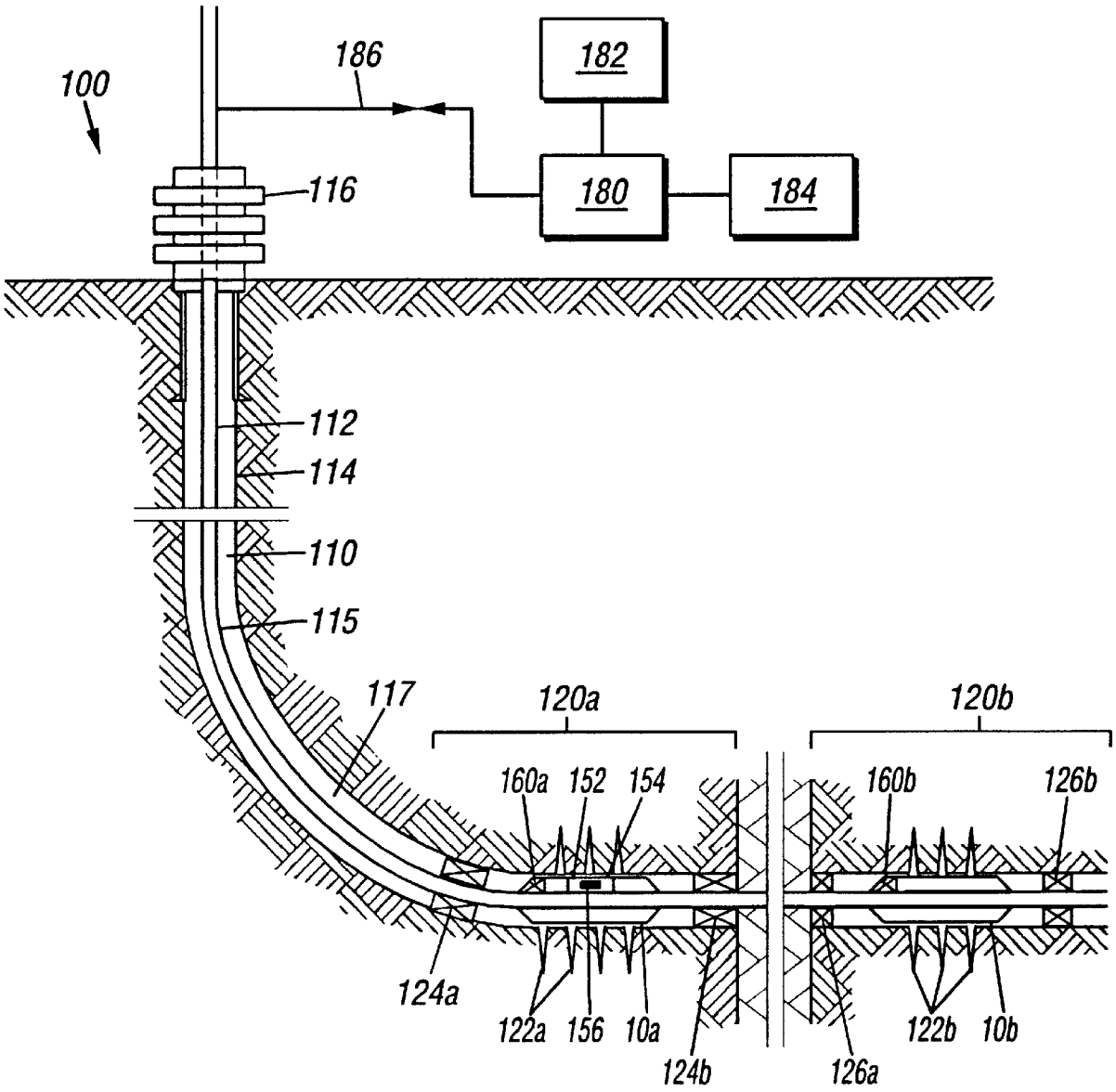
FIG. 2 shows a production system utilizing the flow control device during production of fluids from a plurality of production zones.

FIG. 2 shows a schematic elevational diagram of a production system 100 that utilizes the flow control device 10 of the present invention in a wellbore 110. The wellbore 110 is shown producing from two zones 120*a* and 120*b* through perforations 122*a* and 122*b* respectively made in the casing 114. A production string 112 is placed in the wellbore 110 for transporting the formation fluid to the surface. The production string 112 includes a flow tubing 115 conveyed into the wellbore 110. A flow control device 10 of the present invention is placed in the production string 112 corresponding to each of the perforated zones. In the example of FIG. 2, flow control devices 10*a* and 10*b* are placed in the production string 112 such that they respectively are adjacent to the perforations 122*a* and 122*b*. A packer 124*a* is placed in the annulus between the production string 112 and the casing 114 above the flow control device 10*a* to prevent the passage of the fluids through the annulus 117 above the packer 124*a*. A packer 124*b* is similarly placed below the device 10*a* to prevent the fluid from the production zone 120*a* to flow below the perforations 122*a*. These packers ensure that the fluid from the zone 120*a* can pass into the production string only through the flow control device 10*a*. Packers 126*a* and 126*b* are similarly placed on either side of the flow control device 10*b*.

Each of the flow control devices, such the illustrated devices 10*a*–10*b*, installed downhole as described above communicates with a surface control unit 180, which, as noted earlier, preferably contains a computer. A display/monitor 182 is coupled to the control unit 180 for displaying any desired information, including the position of the sleeve for each of the downhole flow control devices, the flow rate from each of the producing zones, the pressure and temperature of each of the producing zones and the corresponding pressure and temperature in the production string. A recorder 184 may be provided for recording any desired information. The downhole flow control devices may communicate with the surface control unit via one or more wires 186 associated with the production string or via a transmitter/receiver combination associated with each of the flow control devices. Transmitter/receiver units 160*a* and 160*b* are shown respectively associated with the downhole flow control devices 10*a* and 10*b*.

Typically the flow control devices, including the illustrated devices 10*a* and 10*b*, are initially set at the surface to allow a predetermined flow therethrough. Over time the formation conditions, and thus, the production from each zone, changes. The flow rate through each of the flow control devices is then independently adjusted to provide optimum hydrocarbon production from the producing zones. If a particular zone starts to produce mostly water, the flow control device may be completely closed in order prevent any fluid production from such a zone. Typically, the flow rate from each producing zone decreases over time. The system of the present invention enables an operator at the surface to independently and remotely adjust the flow of fluids from each of the perforated zones, without shutting down production.

In an alternative embodiment, the control circuit, such as control circuit 50 (see FIG. 1), in each of the flow control devices, may communicate with each of the other flow control devices in the production string and control the flow through its associated flow control device to optimize the production from the wellbore 110. The instructions for controlling the flow may be programmed in downhole memory associated with each such control circuit or in the surface control unit 180. Thus, the present invention provides a fluid flow control system, wherein the flow rate associated with any number of producing zones may be independently adjusted, without requiring the use physical intervention, such as the use of a shifting device, or requiring the retrieval of the flow control device or requiring shutting down production.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A fluid flow restricting device for use in a wellbore that is producing a fluid from a zone of interest, comprising:

(a) an elongated body for placement within the wellbore adjacent to the zone of interest;

(b) a fluid communication member in the body for enabling the fluid to flow from the zone of interest into a first section inside the body;

(c) a flow control device in the body for receiving the fluid from the first section, said flow control device having (i) a tortuous path for receiving the fluid from the first section and passing the received fluid to a second section, (ii) a slidable member associated with the tortuous path and adapted to be positioned between a first position and a second position for controlling the fluid flow rate through the tortuous path; and (d) an electrically-operated device within the body for positioning the slidable member at a predetermined position between the first and second positions.

2. The device of claim 1, wherein the tortuous path is a labyrinth.

3. The device of claim 2, wherein the slidable member is a sleeve.

4. The device of claim 3, wherein the fluid communication member is a sand screen for preventing debris from flowing from the zone of interest into the body.

5. The device of claim 1 further having a control circuit for controlling the operation of the electrically-operated device.

6. The device of claim 5, wherein the control circuit is placed within the body.

7. The device of claim 5, wherein the control circuit is placed at a remote place from the device.

8. The device of claim 7, wherein the control circuit communicates with the electrically-operated device via a conductor.

9. The device of claim 7, wherein the control circuit communicates with the electrically-operated device via two-way telemetry.

10. The device of claim 5 further having a port for passing the fluid leaving the tortuous path into a section within the body for transporting the fluid to a surface location.

11. The device of claim 7, wherein the control circuit includes a memory for storing programmed instructions therein associated with the control circuit.

12. A method for producing formation fluids from a wellbore perforated at a zone of interest, comprising:

(a) placing a production string within the wellbore, the production string having a screen member for preventing the flow of certain solids from entering into the production string;

(b) passing the formation fluid entering the production string through a restriction device having a tortuous path, the tortuous path defining a pressure drop for the formation fluid; and (c) adjusting the tortuous path while the restriction device is in a downhole location from a surface location to control the pressure drop.

13. A system for producing fluids from a producing location within a wellbore, comprising:

(a) a production string conveyed in the wellbore; and (b) a flow control device on the production string placed adjacent the producing locations, the flow control device having:

(i) a fluid communication member for enabling the fluid to flow from its associated producing location into the flow control device;

(ii) a tortuous path within the flow control device for receiving said fluid from said fluid communication member;

(iii) a slidable member over the tortuous path for defining the length of the tortuous path; and (iv) an electrically-operated device within the flow control device for positioning the slidable member at a predetermined position.

14. A system for producing fluids from a plurality of producing locations within a wellbore system, comprising:

(a) a production string conveyed in the wellbore; and (b) a flow control device on the production string placed adjacent each of a selected producing location, the flow control device having:

(i) a fluid communication member for enabling the fluid to flow from its associated producing location into the flow control device, (ii) a tortuous path within the flow control device for receiving the fluid from fluid communication member, (iii) a slidable member over the tortuous path for defining the pressure drop of any fluid flowing through the tortuous path, and (iv) an electrically-operated device within the flow control device for positioning the slidable member at a predetermined position.

15. The device of claim 14, wherein the tortuous path is a labyrinth.

16. The device of claim 15, wherein the slidable member is a sleeve.

17. The device of claim 16, wherein the fluid communication member is a sand screen for preventing debris from flowing from the zone of interest into the body.

18. The device of claim 14 further having a control circuit for controlling the operation of the electrically-operated device.

19. The device of claim 18, wherein the control circuit is placed within the flow control device.

20. The device of claim 18, wherein the control circuit is placed at a remote location from the device.

21. The device of claim 20, wherein the control circuit communicates with the electrically-operated device via a conductor.

22. The device of claim 20, wherein the control circuit communicates with the electrically-operated device via two-way telemetry.

23. The device of claim 18 further having a port for passing the fluid leaving the tortuous path into a section within the flow control device for transporting the fluid to a surface location.

24. A method for controlling flow of a fluid from a formation into a wellbore through a flow control device adapted to receive fluid from the wellbore into an interior section of the device, comprising:

(a) placing the device in the wellbore to allow the fluid from the wellbore to enter into the flow control device;

(b) passing the fluid entering the flow control device through a tortuous path, said tortuous path defining a predetermined pressure drop for the fluid; and (c) positioning an electrically-operated sliding sleeve over the tortuous path to define the length of the tortuous path.

25. A method for controlling flow of a fluid from a formation into a wellbore; comprising:

(a) placing a flow control device at a selected location within the wellbore, the flow control device adapted to receive fluid from the wellbore into an interior section of the flow control device;

(b) passing the fluid entering the flow control device through a labyrinth; and (c) selectively controlling the flow of the fluid through the labyrinth by adjusting the position of an electrically-operated device on the labyrinth.

26. The method of claim 25, wherein the flow control device has an associated downhole control circuit for controlling the operation of the electrically-operated device.

27. The method of claim 25 further comprising the step of providing a control unit at a surface location for providing command signals to the downhole control circuit for controlling the operation of the electrically-operated device.

28. The method of claim 27, wherein the surface control unit communicates the command signals to the downhole control circuit via a telemetry.

29. The method of claim 25, wherein the electrically-operated device is a slidable sleeve that may be placed over the labyrinth at any desired location between a predetermined range.

30. A downhole tool for use in a wellbore that is producing a fluid from a zone of interest, comprising:

(a) a body for placement within the wellbore adjacent to the zone of interest said body adapted to receive the fluid from the zone of interest;

(b) a flow control device in said body having a tortuous path for receiving the fluid, said flow control device having a slidable member for controlling the fluid flow rate through the tortuous path; and (c) an electrically-operated device operatively connected to said flow control device for positioning the slidable member to control the fluid flow rate.

31. A system for producing a fluid from a producing location within a wellbore, comprising:

(a) a production string conveyed in the wellbore; and (b) a flow control device on the production string, said flow control device having a tortuous path for receiving the fluid and further having a slidable member for controlling the fluid flow rate through the tortuous path; and (c) an electrically-operated device operatively connected to the flow control device for positioning the slidable member to control the fluid flow rate through the tortuous path.

* * * * *